United States Patent [19]

Dinges et al.

[11] 4,240,011

[45] Dec. 16, 1980

[54] KEYBOARD OPERATED CONTROLLER

[76] Inventors: Frank Dinges, 176 W. 87th St., New York, N.Y. 10024; Tartaglio, Robert L., c/o Design Circuit Inc., 141 5th Ave., New York, N.Y. 10010

[21] Appl. No.: 925,039

[22] Filed: Jul. 17, 1978

[51] Int. Cl.[3] ..... H05B 37/02

[52] U.S. Cl. ..... 315/292; 200/DIG. 1; 315/293; 315/294; 315/316; 328/70; 340/365 C; 340/711; 340/800

[58] Field of Search ..... 315/292, 293, 312, 316, 315/294; 328/70; 362/811; 340/703, 704, 711, 799, 800, 365 C

[56] References Cited

U.S. PATENT DOCUMENTS 4,095,139 6/1978 Symonds et al. ..... 315/293 X

*Primary Examiner*—Eugene R. LaRoche

*Attorney, Agent, or Firm*—Posnack, Roberts, Cohen & Spiecens

[57] ABSTRACT

A keyboard operated controller for controlling a plurality of lighting devices has a memory which includes a plurality of addressed multiposition registers wherein the positions store control indicia for the respective lighting devices. A finger-operated keyboard generates addresses which select the registers to control the states of the lighting devices. There is also provided means for loading the control indicia into the registers via another keyboard.

11 Claims, 6 Drawing Figures

KEY BOARD KS

KEY SWITCH KSW

HOLD MEANS HM

KEYBOARD OPERATED CONTROLLER

FIELD OF INVENTION

This invention relates to discotheque lighting and to keyboard operated controllers and, more particularly, to keyboard operated controllers which utilize addressed memories for storing control information.

BACKGROUND OF THE INVENTION

There are many situations in which it is desirable to be able to give a person the opportunity to create unusual effects by the use of electrical phenomena. A very common instance of such an effect is the creation of sounds by means of key controlled oscillators.

Lately, there has arisen the need to control lighting and other stimuli perceived by sensory organs in shows and discotheques and the like. Along these lines, there have been provided lighting control systems using repetitive and even pseudorandom schemes.

Initially, the results of such equipment have been impressive. However, subsequently, it has been found that there is little or no relation, for example, between the light switching and the beat of the music which is to be matched. In order to remedy this drawback, there have been built touch control systems wherein an operator controls the lighting in response to his feel for the music. Such systems have created a demand for even more versatile systems.

A Broadway show, for example, runs for only about three hours. During a three hour show, a lighting control man may be called upon to make only fifteen hundred different changes, or respond to fifteen hundred different cues at a maximum. With respect to a discotheque lighting man, he will have to work for approximately six to eight hours. During that period, he may have to use as many as ten thousand cues and possibly even more. As a consequence, the sheer weight of memory is beyond what anybody has the experience or capability to deal with even an ongoing musician.

Everything is regarded as a cue. The intensity of light, the particular light selected, how it is changed, how fast it is change, etc. The secret of "disco" jockeying is never to skip a beat and not to break the rhythms and to be able to mix into a record smoothly without changing tempo or, if one does change tempo, to do so with such precise synchronization that he does not break the movement of the people dancing on the floor.

It's important to note that disco jockeying is set up and disco jockeys are qualified by the way they pick records in accordance with what is wanted by the people, who are dancing on the floor. The lighting man who exercises control over the lighting has to follow the disco jockey.

More specifically, he has to follow the disco jockey just like the disco jockey is picking the records. The lighting man has to establish a rhythm and a tone and a feeling for the people who are dancing. Thus, the disco jockey and lighting man operate together in synchronism and in cooperation.

One reason for not necessarily recording a predetermined sequence of cues is that one has to be able to read the audience. One night the audience may be warm whereas on another night, the audience may be cold. The lighting man may have to change his attack. Therefore, the ability to be able to use a manual override is important. Stated otherwise, it is superior not to have a sequence recorded or fixed because the same sequence is not likely to be used from night to night. A record or song may come up at a different time or before a different audience-in which event the audience has got to be read and the music has got to be interpreted in a different way. Consequently, although the idea is to have a lighting response built up and recorded for a beat, the beats might not necessarily follow with the same sequence of interpretation.

Ambience is a characterization to be regarded in connection with disco jockeying and lighting control and the lighting man is an operator to be used in connection with ambience. The lighting man sets the levels of ambience. He is the one who makes the ambience. Ambience can be made much darker and much brighter. One can liven it up or tone it down. It's the lighting man and how he reads the music and the dance crowd, and how he can interpret this, limited by the sophistication of his equipment, all of which gives him flexibility in the course of an evening.

For instance, discotheque club owners are always changing room designs. They interchange their room designs and may emphasize certain areas at one time and deemphasize them at another time, say after a month or so. They keep changing the highlighting and keep moving things around, thereby making the club look like there is always something happening. The lighting man can, for example, make four, five or ten different types of light settings and, then, depending on what the audience is doing on that night, or depending on how everything is going, he can choose one out of ten settings that he has already set up.

There is heavy competition in the discotheque field. Flexibility is the key word. Versatility is what is demanded. How to make something worth over and over again what is paid for it without its getting stale or static is the important thing for all club owners. How to make their places look like they have been redesigned is what interests club owners.

Discotheque club owners do more with the environment than change the lighting. Sometimes, for example, they may change the carpet. Sometimes they may change the seating arrangements or make other basic changes. The club owner has to judge exactly what has become stale in his club. He has to adapt to change because there are always new people coming into his club and there are always new things happening. He has to compete for the entertainment dollar just like the movie theatre owner and television does.

As will be shown hereinafter, the control of the present invention allows the club owner, through the lighting man, to use his equipment over and over again in different combinations so that it looks like it's always different. For instance, by taking a ten-channel chase-track design and running it from one to ten all the time, this makes it look like strictly a from one-to-ten arrangement. However, if all of a sudden, one were to change it and run it as 1,2 then 3,4 then 5,6—then that combination is changed. To the eye, it looks different even though it's the same light source.

The same thing occurs with any sort of ten channel arrangement, whether it's neon, pin beams or just architectual lighting around a room. The minute one starts changing it, either in intensity or in accent or detailing, it looks different to the eye and, hence, it affects people psychologically and makes viewers think there has been change.

BRIEF SUMMARY OF INVENTION

It is an object of the invention to provide an improved discotheque lighting control or the like.

It is another object of the invention to provide a stimulus control having great flexibility and versatility.

Another object of the invention is to provide an improvement in ambience control to avoid boredom and repetition.

Still another object of the invention is to provide an improved control capable of being played like a musical instrument and having selectably adjustable responses to key manipulation.

Yet another object of the invention is to enable a change of sequence in selection of different lighting arrangements.

It is an object of the invention to provide improved control systems and methods which expand the possibilities for the creation of sensory effects by an operator of a keyboard.

It is still a further object of the invention to provide improved and special effects including ultra-fast operation and the capability of tying the system of the invention to external controls for chasing effects and the like.

The apparatus of the invention is in the form of a lighting instrument that's actually a musical instrument for the interpretation of music. The fact is that it's a new and revolutionary way of being instrumental with such a high degree of versatility. It provides for a lighting man to be able to play lights musically.

The apparatus of the invention can, furthermore, control sound and smoke as well as other usefully perceptible stimuli. It can be used to create different sorts of sounds.

Briefly, in accordance with one aspect of the invention, there is contemplated the controlling of a plurality of lighting devices by storing, in a set of addressed multiposition registers, control signals for controlling the states of the lighting devices. Each position of a register is, for example, associated with one of the lighting devices. The registers are selected by generating addresses with a finger-operated keyboard device. The contents of the selected registers are transferred to the lighting devices which assume states which are dependent on the contents of the positions of the selected register.

Another aspect of the invention is concerned with the provision of control apparatus for controlling a plurality of electrically actuatable devices.

In accordance with each aspect of the invention, there are employed finger-operated switches and, according to still further features of the invention, there are disclosed two different types of finger-operated switches.

Other objects, features and advantages of the invention will be apparent from the following detailed description when read with the accompanying drawing which shows, by way of example and not limitation, the presently preferred embodiment of the invention.

DESCRIPTION OF THE PREFERRED EMBODIMENT

There are at least seven major light forms used in discotheque lighting. These include neons, curtains, strobes, pin beams, flourescents, and so fourth. The lighting man has to keep rearranging the use of these lights so that the result and the music always have some sort of appeal to an audience. Visual appeal to the audience is one of the best ways to accomplish this, and that is essentially what the lighting man is faced with. He's dealing with a static thing. The only way he can make it look different is by making those lights seem to appear to move to music in such an accurate form that it becomes visually exciting.

Figure 1:
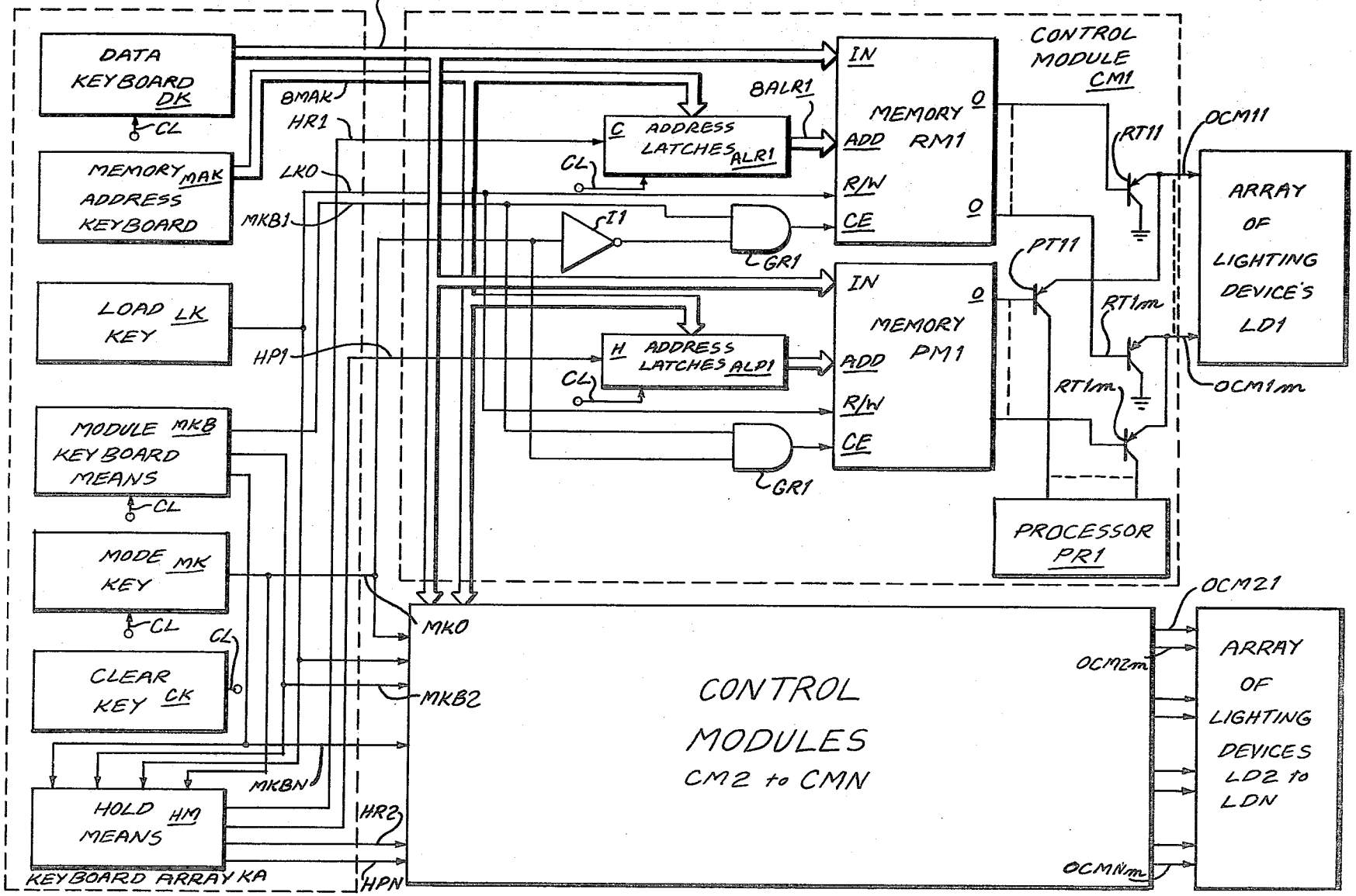
FIG. 1 is a partly block, partly logical diagram of an operator-controlled lighting system in accordance with one embodiment of the invention.

In FIG. 1, there is shown a keyboard-controlled lighting system including N arrays of lighting devices LD1 to LDN respectively controlled by control modules CM1 to CMN in response to an operator's depressing keys in keyboard array KA.

The m lighting devices in each array of lighting devices LDN can take many forms such as sets of colored incandescent lamps, neon tube lights, other gaseous lamps, strobe lights, etc.

A typical control module CM1 which controls the typical array LD1 via leads OCM11 to OCM1m centers around recall memory RM1 and processor memory PM1. Each of these memories which is a random access memory having a plurality of addressable multibit registers can be similar to an Intel type 5101 having m data outputs, m data inputs, eight address inputs, a chip enable input CE and read/write control input R/W. The memory RM1 has its m data outputs connected in parallel to the base electrodes of transistors RT11 to RT1m whose emitter electrodes are connected to different lighting devices in array LD1 and whose collector electrodes are grounded. In a similar way, the m data outputs of memory PM1 are connected to the base electrodes of transistors PT11 to PT1m whose emitter electrodes are connected in parallel with the emitter electrodes of transistors RT11 to RT1m respectively and whose collector electrodes are connected to processor PR1.

The m data inputs of each memory are connected to m-lead data keyboard cable DKm. The eight address inputs of memory RM1 are connected, via 8-lead cable 8ALR1, to address latches ALR1. The eight inputs of memory PM1 are connected, via 8-lead cable 8ALP1, to address latches ALP1. The read/write inputs of both memories are connected to load lead LKO. The chip enable input of memory RM1 is connected to the output of two-input AND circuit GR1 whose inputs are connected to lead MKB1 and via inverter I1 to lead MKO. The chip enable input of memory PM1 is connected to the output of two-input AND-circuit GP1 whose inputs are connected to lead MKB1 and to lead MKO.

The processor PR1 can be a unit which generates periodically recurring pulses for controlled dimming or for blinking, etc. for use, for example, in chases or other sequential and repeated patterns.

The keyboard array KA includes a data keyboard DK comprising m key units having outputs connected to the respective lines of cable DKm. Whenever a key is depressed, the signal on the respective lead of the cable switches between a first and a second level in a toggle manner. The memory address keyboard MAK includes eight switches which when depressed change the level on the respective eight leads of cable 8MAK feeding inputs of the eight latches in address latches ALR and address latches ALP in the control modules CM1 to CMN. The load key LK when depressed changes the level of lead LKO to switch the memories RM and PM to the write mode. The module keyboard means MKB comprises a plurality of switches which when depressed in combinations generate signals which are decoded onto the respective leads MKB1 to MKBN to select access to a particular control module. These switches operate in a toggle manner. The mode key MK, via signals on lead MKO, selects whether the recall memory or the processor memory of a control module will be accessed. This switch operates in a toggle manner.

In general, binary data concerning the controlling of the lighting devices is first loaded into the memories as follows. The desired keys of data keyboard DK are depressed and released resulting in certain of the leads of cable DKm going high as do the corresponding data inputs of all memories. Then there are stroked the desired keys of module keyboard means MKB to select a module and the mode key MK is stroked to select a pair of memories. At this point, data is present at the input of every memory but only one pair of memories has been selected. Next, the operator depresses the desired keys of the memory address keyboard MAK to access the desired multibit register. At the same time, he depresses the load key causing a signal on line LKO to initiate the writing of the contents of the cable DKm into the register selected by the signals in the address latches of the selected memory of the selected control module.

Thereafter, the operator can clear the data keyboard DK, the module keyboard means MKB and the mode key MK by either redepressing the same keys or by depressing the clear key CK twice to generate a CL signal for clearing.

Once the registers of the memories are loaded in this manner, one can use the contents of the registers to control the lighting devices. A register for controlling the lighting is selected in exactly the same way as a register was selected to receive control data. There are two differences. First, the data keyboard DK is not operated; and, secondly, the load key LK is not depressed.

Once the desired keys of the module keyboard means MKB are depressed and the mode key MK depressed or not, a particular memory has been selected so that when the desired keys of the memory address keyboard MAK are depressed the contents of a selected register are available at the outputs of the particular memory selected.

Assuming that the mode key MK was depressed, the selected memory would be one of the recall memories, say, memory RM1. A combination of the transistors RT11 to RT1m would then conduct activating the associated lighting devices of the array LD1 due to the grounded collector electrodes.

If the mode key MK had not been depressed, the selected memory would be one of the processory memories, say, memory PM1. A combination of the transistors PT11 to PT1m would conduct. However, the activation of the selected lighting devices would depend on the signals generated by the processor PR1.

In normal operation, when the operator releases the keys of the memory address keyboard MAK, the register selection terminates and the selected lighting devices return to a home state. In order to keep the selected lighting devices on, upon the release of the keys prior to selection of another register, there is provided the hold means HM which operates in conjunction with the address latches ALR and ALP.

The address latches can be conventional latches that operate as follows: as long as input C is low, the data outputs of the latches follow the data inputs of the latches; when the C input goes high, the latches store what is then present on the data inputs and continue such storage until the C input goes low. Such latches can be of the type 4042.

Figure 6:
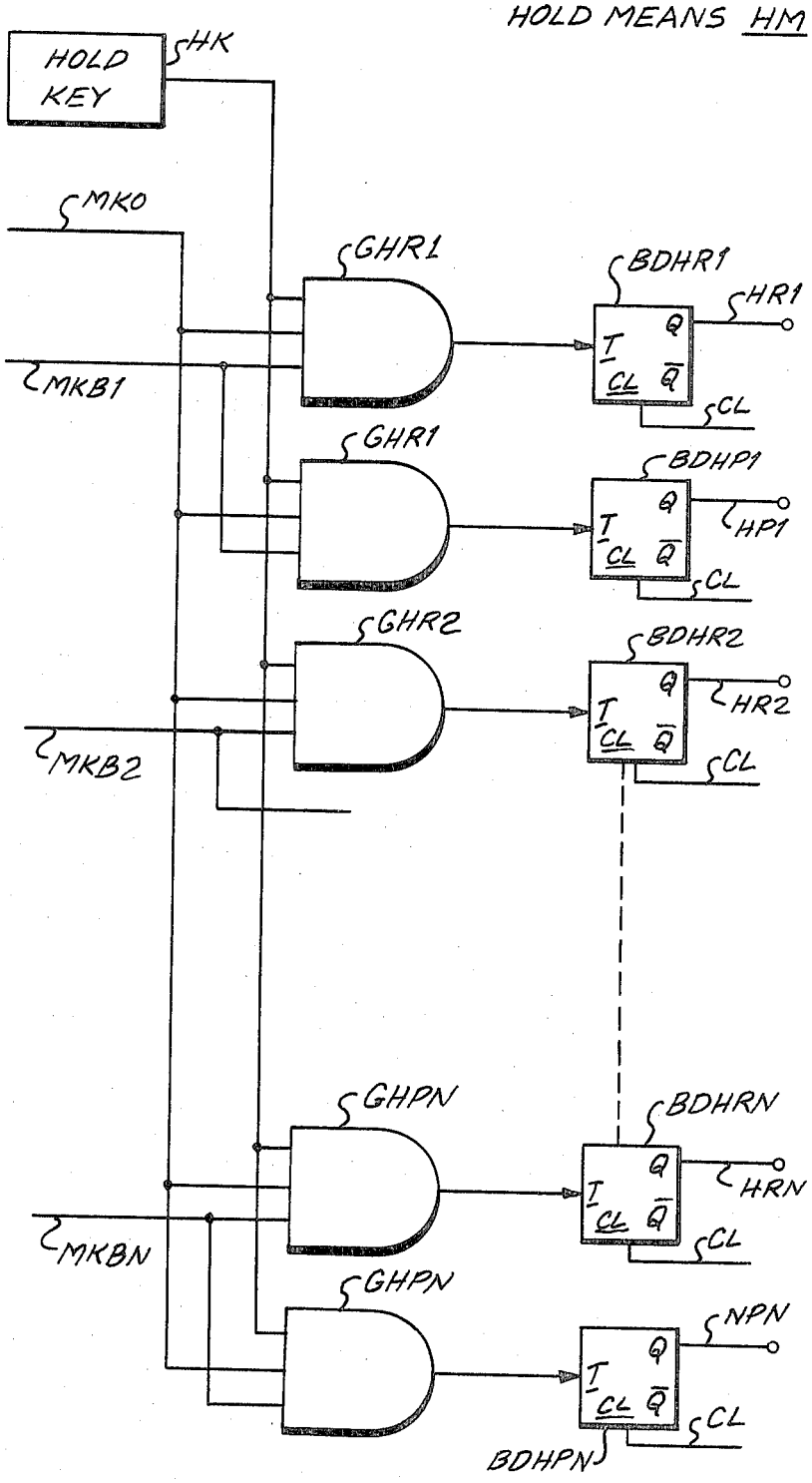
FIG. 6 is a logic diagram of the hold means of FIG. 1.

In order to control the latches to be "transparent" or to hold until later cleared, the hold means HM of FIG. 6 is provided. In general, the AND-circuits GHR and GHP select which of the address latches is to be accessed for the hold or release routine. The signal on lead MKO from mode key MK and the signal on leads MKB on from module keyboard means MKB alert one of the AND-circuits which are strobed by hold key HK.

For purposes of explanation, let it be assumed that all binary dividers BDH have been initialized to the off state. If now one desires to hold a particular address continuously in memory RM1 of control module CM1, one strokes the mode key and the desired keys of the module keyboard means MKB and then the hold key.

The binary divider BDHR1 is toggled to the one state and emits a signal on lead HR1 to the clock input of address latches ALR1. Thus, the latches continuously select the associated memory register until the latches are cleared or released either by stroking the clear key CK or again selecting these latches by stroking the hold key, the associated keys of the module keyboard means MKB and the hold key HK.

Figure 2:
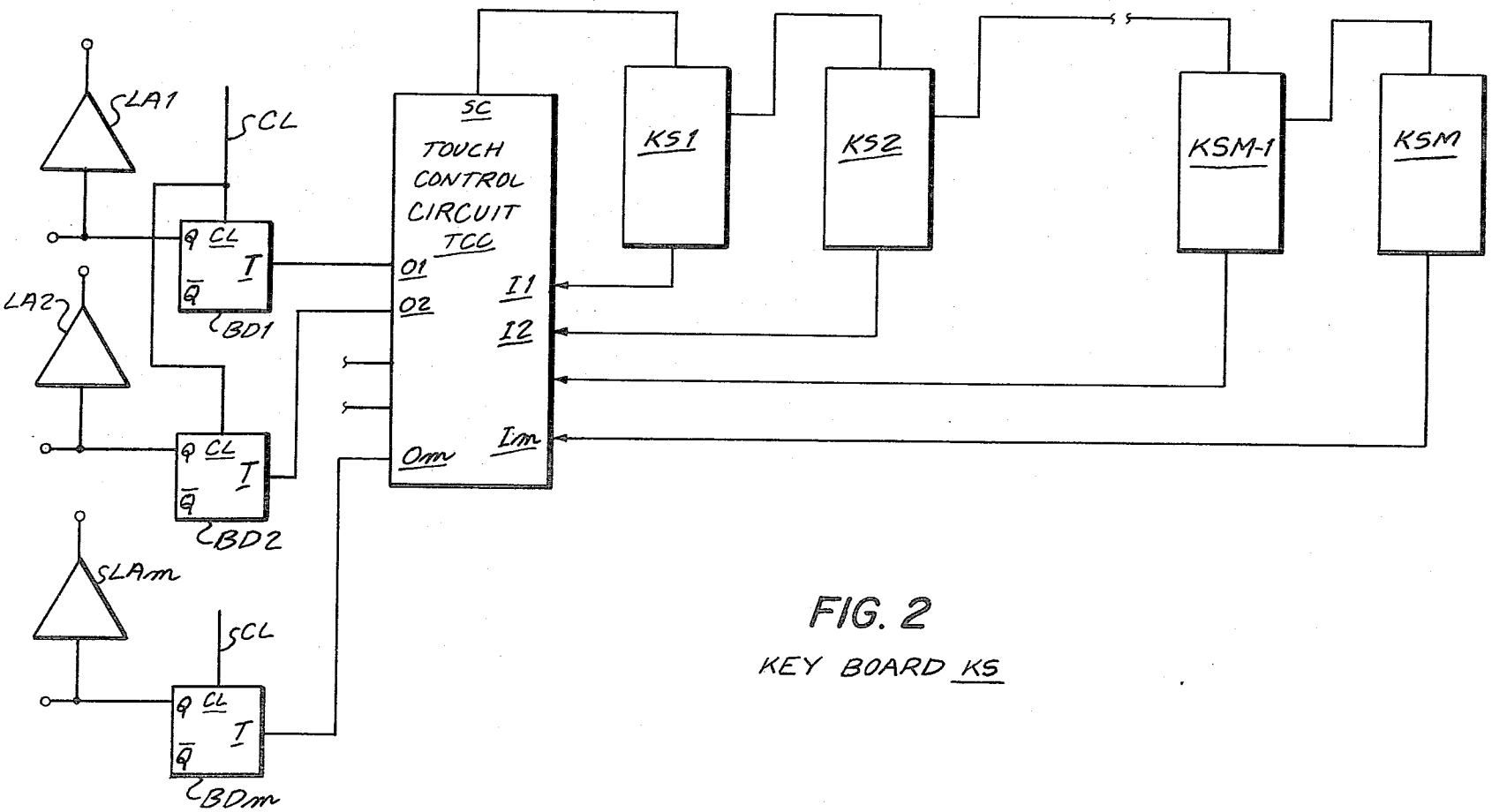
FIG. 2 is a partly block, partly logical diagram of one of the keyboards of FIG. 1.

The keyboards and the key switches are of two types. The data keyboard DK and the memory address keyboard MAK because of their numbers of keys are best realized by the keyboard shown in FIG. 2. The keyboard Ks centers around a capacitance type touch control circuit TCC which can be of the type S9263 made by American Microsystems, Inc. Circuit TCC has the properties next described. It periodically emits a strobe pulse on output terminal SC and then samples the input terminals I1 to Im for a change in signal level. If a change is detected at a particular input terminal, its associated output terminal O1 to Om emits a pulse.

The strobe pulse is fed to all the key switches KS1 to KSM in series so as to minimize the loading on the strobe pulse. Thus, the inputs to each key switch are fed in series but the output of each switch KS is connected to a respective input.

Each output Om of the circuit TCC is connected to the toggle input of a binary divider BDn whose output is connected to a lamp driver LA and a cable lead. If the keyboard KS is used for data keyboard DK then the Q outputs are connected to leads of cable DKm. In operation, assuming a clear signal has been received on line CL which initializes all dividers to the $\overline{Q}$ state, when a key switch KSn is touched by an operator, the pulse on line SC "passes through" switch KSM to input Im which emits a signal on line Om. This signal sets binary divider BDm to the Q state giving a high output at the Q terminal. This output will stay high until toggled off by another operator strobe of switch KSm. If the toggling phenomenon is not desired, the binary dividers can be replaced by linear amplifiers.

Figure 3:
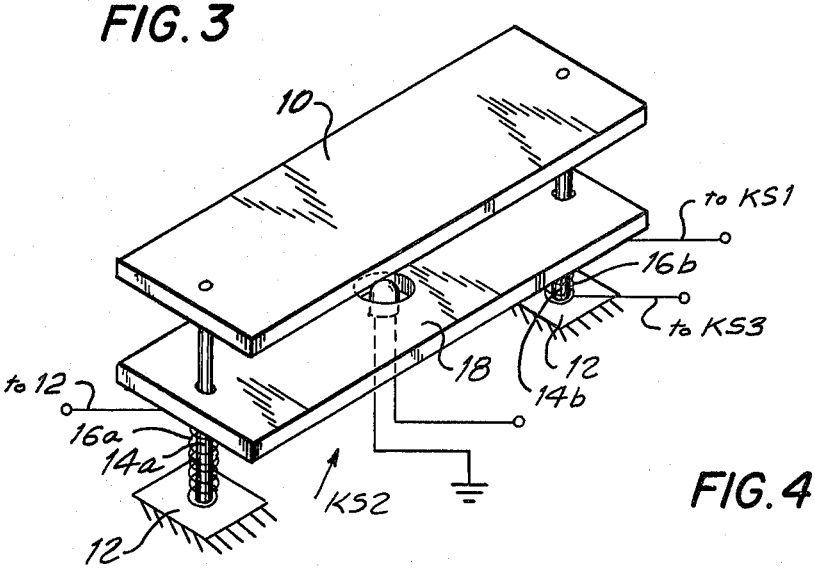
FIG. 3 is a perspective view of one of the keys of the keyboard of FIG. 2.
Figure 4:
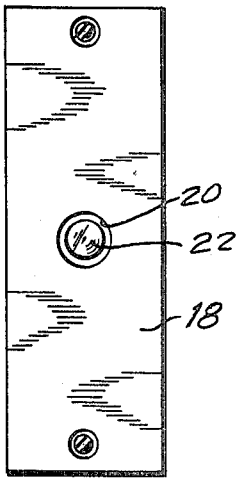
FIG. 4 is a plan view of a portion of the key of FIG. 3.

Generally, the touch control circuits require capacitive type switches to obtain reliable operation because the circuit relies on differential changes in voltage. The types of capacitive switch normally required imposes severe limitations on the keyboard format. Accordingly, the keyswitch KS1 of FIGS. 3 and 4 is used. It constitutes a feature of the invention.

The key switch of FIGS. 3 and 4 comprises a touch plate 10 of conductive material such as aluminum supported on a frame 12 by two upright metal posts 14*a* and 14*b*. The posts may be, for example, fabricated of steel having a diameter of 0.110. Wrapped around post 14*a* is a copper wire winding 16*a* having one end connected to input terminal I2 of the circuit TCC and having its other end floating. Wrapped around post 14*b* is a similar copper wire winding 16*b* having one end connected to an end of a corresponding winding in switch KS1 and having another end connected to an end of a corresponding winding in switch KS3 wire windings may be of 0.040 diameter wire wound in coils of about 0.170 outside diameter. Between touch plate 10 and frame 12 there is a translucent plate 18 of plexiglass or the like with a central hole 20 for receiving a lamp 20 for edge lighting the plate 18.

It has been found that when a pulse signal is received by winding 16*b*, there is no output unless a finger is touching the touch plate 10. In such case, a signal is emitted by touch control circuit TCC (FIG. 2) to the toggle input T of binary divider BD2. If the divider is toggled on, lamp driver LA 2 energizes lamp 22 to edge light the plastic plate 18. The next time the plate 10 is touched, the divider will toggle off and the lamp 22 will extinguish.

Figure 5:
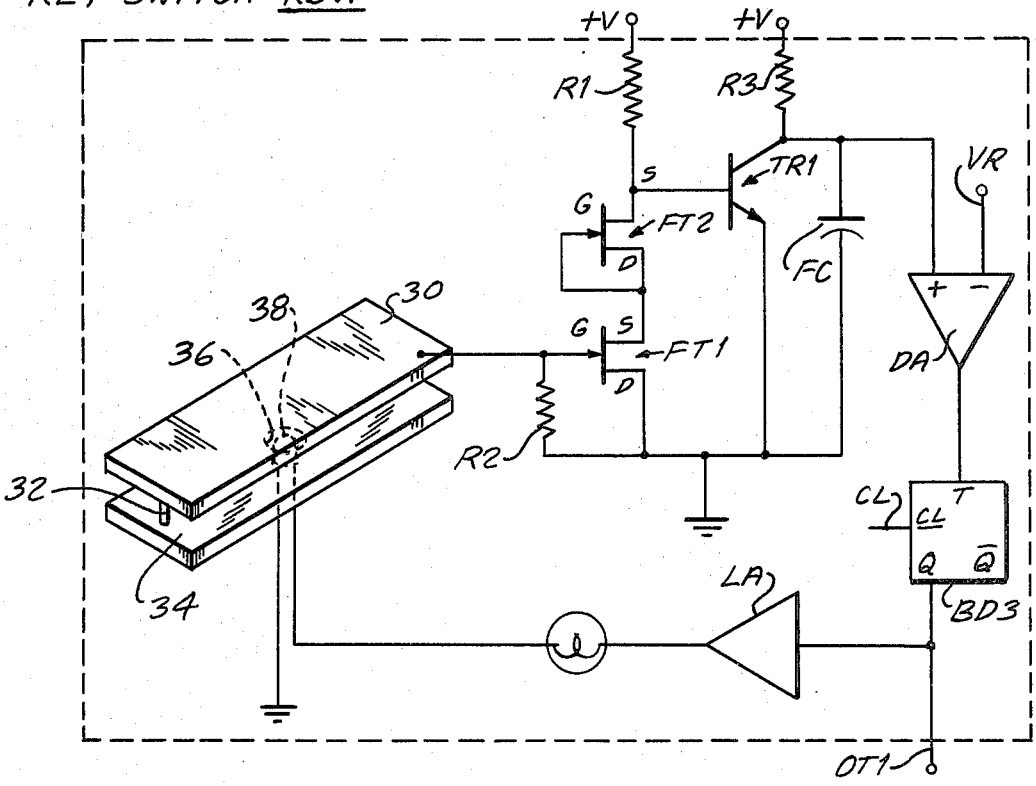
FIG. 5 is a schematic diagram of a circuit associated with another key switch.

If there is only one or a few keys to an entity such as load key LK or mode key MK, it may be desirable to use a key switch KSW as shown in FIG. 5. In ths case, a touch plate 30 of conductive material is supported by studs 32 above a plexiglass plate 34. Plate 34 is provided with a central opening 36 in which is fitted an incandescent bulb 38 to edge light the plate 34.

Touch plate 30 is connected to the gate electrode of N channel FET transistor FT1. FET transistor FT1 and FET transistor FT2 are connected in series between a load resistor R1 connected to an operating voltage source V and a reference potential (ground) with the source electrode of transistor FT1 being connected to the drain electrode of transistor FT2. A resistor R2 of high value interconnects the gate and drain electrodes of transistor FT1 while the gate and drain electrodes of transistor FT1 are directly interconnected.

The source electrode of transistor FT2 is connected to the base electrode of NPN transistor TR1 having a grounded emitter electrode and a collector electrode connected via a load resistor R3 to source V. A filter capacitor FC connects the collector electrode to ground.

A difference amplifier DA acting as a high input impedance threshold circuit has its positive input connected to the collector electrode of transistor TR1 and its negative input connected to a reference potential source VR. The output of the difference amplifier DA is connected to the toggle input T of binary divider BD3 whose Q output is connected to an output terminal OT1 and the input of lamp driver LA connected to lamp 38.

Assuming the divider BD3 to be in the $\overline{Q}$-state in response to a clear signal on line CL, the operation of the circuit will next be described. As long as an operator does not touch plate 30, transistors FT1 and FT2 are conducting causing the base electrode of transistor TR1 to be low and transistor TR1 to be cut off. When an operator touches the touch plate 30, the transistors FT1 and FT2 turn off, switching transistor TR1 on. When the signal therefrom exceeds the reference voltage, difference amplifier DA emits a signal to divider BD3 with toggles on. The Q output of divider BD3 goes high sending a signal to terminal OT1 and causing lamp driver LA to light lamp 38. When the finger is removed, the system reverts to the last state, except that the binary divider BD3 remains on. The next time the plate is touched, the divider BD3 is toggled off. If toggle action is not desired, the binary divider can be replaced with a linear amplifier.

The use of the cascaded field-effect transistors greatly increases the gain of the device while reducing the reflected impedance at the input. The capacitor FC not only reduces the effect of 60 Hz interference but also provides a delayed attack and release time which is very important for the ideal response factor of the switch. The difference amplifier DA prevents possible flickering and inter-key disturbances.

While the preferred embodiment of the invention has been shown and described in detail, there will now be obvious to those skilled in the art many modifications, satisfying many or all of the objects of the inventors without departing from the spirit thereof as defined by the appended claims.

What is claimed is:

1. Apparatus for controlling the operation of a plurality of electrically actuatable devices comprising a memory means including a plurality of addressed multiposition registers, each position of a register corresponding to one of the electrically actuatable devices and being adapted for storing an indicium to establish a desired state of the device, there being a plurality of positions corresponding to the electrically actuatable devices, addressing means for receiving an address for selecting respective of said addressed multiposition registers to limit the controls of the positions for controlling the electrically actuatable devices, and address input means for generating and transmitting addresses to said addressing means, said address input means comprising a finger operated keyboard including capacitance-type touch keys to provide rapid selection of addresses for use in discotheque type lighting.

2. The apparatus of claim 1 wherein said memory means comprises two sets of selectively utilizable addressed multiposition registers and said address input means includes means for indicating to said addressing means from which set an addressed memory register is to be selected.

3. The apparatus of claim 2 further comprising switching means for receiving the contents of a selected register, said switching means having output means connected to the electrically actuatable devices, first input means connected to one of the sets of addressed multiposition registers for directly controlling the states of the electrically actuatable devices and second input means connected to the other of the sets of addressed multiposition registers and a controlling means for controlling the states of the electrically actuatable devices in accordance with the state of said controlling means.

4. The apparatus of claim 2 wherein the plurality of electrically activatable devices is divided into two sets, each set being connected to one of the sets of addressed multiposition registers.

5. The apparatus of claim 1 further comprising data input means for loading indicia into a register selected by said addressing means.

6. The apparatus of claim 1 wherein said keyboard comprises at least one finger-operated touch key including a plate of electrically conductive material, a plate of translucent material adjacent the first said plate, and a lamp adapted to illuminate the translucent plate upon operation of the first said plate.

7. The apparatus of claim 6 wherein said keyboard comprises: a plurality of finger-operated switching means, each of said switching means comprising an elongated metal plate, a first post connected to and extending from said plate and a second post connected to and extending from said plate at a point displaced from said first post, a first winding around said first post, a second winding around said second post; and interrogating means comprising signal generating means connected to one end of one of said first wndings, the other end of said one winding being connected to one end of another of said first windings whereby said first windings are connected in series and serially to said signal generating means, and a plurality of signal receiving means, each of said signal receiving means being connected to one end of one of said second windings respectively.

8. The apparatus of claim 1 wherein said finger-operated keyboard comprises a plate of electrically conductive material, a pair of field effect transistors each having drain, gate and source electrodes, the drain electrode of one of said transistors being connected to the source electrode of the other of said tranistors, means for applying an operating potential between the source electrode of said one transistor and the drain electrode of said other transistor, the gate electrode of said other transistor being connected to said plate, the gate electrode of said one transistor being connected to the source electrode thereof, and output means connected to the drain electrode of said one transistor for emitting a signal whenever said plate is touched by a finger.

9. Apparatus for controlling the operation of a plurality of electrically actuatable devices comprising a memory means including a plurality of addressed multi-position registers, each position of a register corresponding to one of the electrically actuatable devices and being adapted for storing an indicium to establish a desired state of the device, there being a plurality of positions corresponding to the electrically actuatable devices, addressing means for receiving an address for selecting respective of said addressed multiposition registers to limit the controls of the positions for controlling the electrically actuatable devices, and address input means for generating and transmitting addresses to said addressing means; said apparatus further comprising hold means coupled to said address input means for controllably retaining a selected address and controllably maintaining selected actuation of the electrically actuatable devices.

10. Apparatus as claimed in claim 9 comprising processing means to vary control of the electrically actuatable devices as selected by the address retained by the hold means.

11. Apparatus for controlling the operation of a plurality of electrically actuatable devices comprising a memory means including a plurality of addressed multiposition registers, each position of a register corresponding to one of the electrically actuatable devices and being adapted for storing an indicium to establish a desired state of the device, there being a plurality of positions corresponding to the electrically actuatable devices, addressing means for receiving an address for selecting respective of said addressed multiposition registers to limit the controls of the positions for controlling the electrically actuatable devices, and address input means for generating and transmitting addresses to said addressing means, said memory means including a recall memory and a processor memory, selector means for selectively actuating one of said memories, and processing means coupled to said processor memory and generating a periodically recurring signal to vary the control of the electrically actuatable devices, said memories being selectively addressed by the address input means to utilize the indicia for controlling the electrically actuatable devices.

* * * * *